US005279188A

United States Patent [19]

Seeger et al.

[11] Patent Number: 5,279,188

[45] Date of Patent: Jan. 18, 1994

[54] FASTENER HOLDING APPARATUS

[76] Inventors: Leonard L. Seeger; Janice E. Seeger, both of 536 Ridge Rd., North Bend, Oreg. 97459

[21] Appl. No.: 61,561

[22] Filed: May 17, 1993

[51] Int. Cl.[5] ..... B25B 13/00

[52] U.S. Cl. ..... 81/64; 81/125

[58] Field of Search ..... 81/64, 125, 13, 121.1, 81/177.85, 487, 900

[56] References Cited

U.S. PATENT DOCUMENTS

| | | | |
|---|---|---|---|
| 2,701,491 | 2/1955 | Ross | 81/64 X |
| 3,025,734 | 3/1962 | Ash | 81/64 |
| 3,631,747 | 1/1972 | Flor | 81/64 |
| 5,199,331 | 4/1993 | Tsukamoto | 81/121.1 |

*Primary Examiner*—D. S. Meislin

*Attorney, Agent, or Firm*—Leon Gilden

[57] ABSTRACT

A resilient socket is arranged for mounting to a shaft structure in a coaxially aligned relationship, wherein the resilient socket is arranged to receive a fastener such as a nut and bolt or the like permitting grasping thereof for its remote manipulation and securement.

4 Claims, 4 Drawing Sheets

FASTENER HOLDING APPARATUS

BACKGROUND OF THE INVENTION

1. Field of the Invention

The field of invention relates to holding apparatus, and more particularly pertains to a new and improved fastener holding apparatus wherein the same permits the remote securement and positioning of a fastener relative to a workpiece.

2. Description of the Prior Art

In various mechanical applications, fasteners are oriented at remote and difficult portions for access relative to a workman and mechanic. To this end, the instant invention is arranged to overcome deficiencies of the prior art by providing for a resilient socket permitting ease of initial securement and mounting of the fastener to the workpiece permitting employment of subsequent tools for final torquing of the fastener structure.

Prior art devices are exemplified and indicated in the U.S. Pat. Nos. 3,756,096 and 3,853,025, as well as the U.S. Pat. No. 3,507,172.

The instant invention attempts to overcome deficiencies of the prior art by providing for a socket structure having a resilient construction arranged to temporarily secure a fastener member therewithin either in the configuration of a nut or stud structure that may be projected in the socket and in this respect, the present invention substantially fulfills this need.

SUMMARY OF THE INVENTION

In view of the foregoing disadvantages inherent in the known types of holding apparatus now present in the prior art, the present invention provides a fastener holding apparatus wherein the same is directed to the temporary securement of a fastener prior to its mounting to a workpiece. As such, the general purpose of the present invention, which will be described subsequently in greater detail, is to provide a new and improved fastener holding apparatus which has all the advantages of the prior art fastener holding apparatus and none of the disadvantages.

To attain this, the present invention provides a resilient socket arranged for mounting to a shaft structure in a coaxially aligned relationship, wherein the resilient socket is arranged to receive a fastener such as a nut and bolt or the like permitting grasping thereof for its remote manipulation and securement.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fastener holding apparatus which has all the advantages of the prior art fastener holding apparatus and none of the disadvantages.

It is another object of the present invention to provide a new and improved fastener holding apparatus which may be easily and efficiently manufactured and marketed.

It is a further object of the present invention to provide a new and improved fastener holding apparatus which is of a durable and reliable construction.

An even further object of the present invention is to provide a new and improved fastener holding apparatus which is susceptible of a low cost of manufacture with regard to both materials and labor, and which accordingly is then susceptible of low prices of sale to the consuming public, thereby making such fastener holding apparatus economically available to the buying public.

Still yet another object of the present invention is to provide a new and improved fastener holding apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
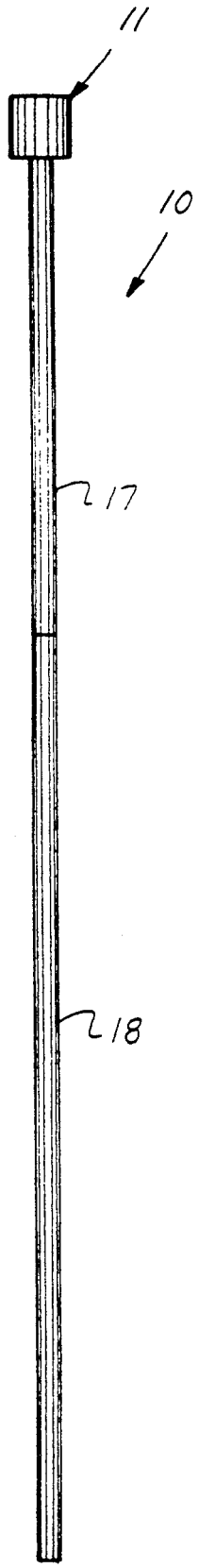
FIG. 1 is an orthographic view of the invention.
Figure 2:
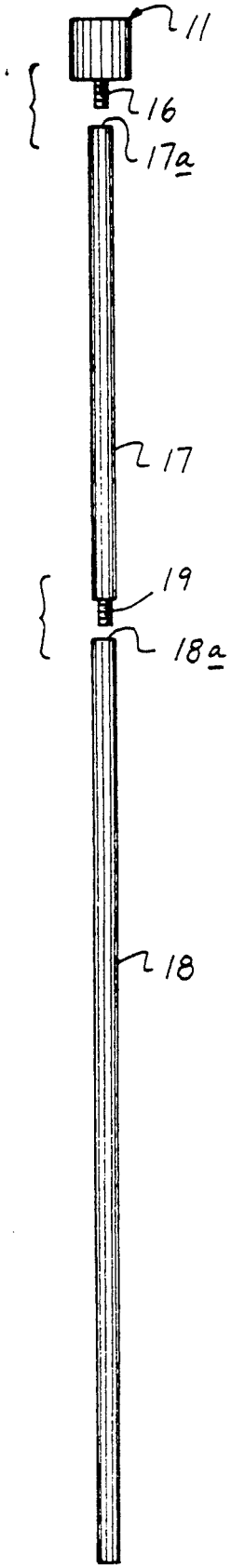
FIG. 2 is an orthographic view of the invention in a disassembled configuration.
Figure 3:
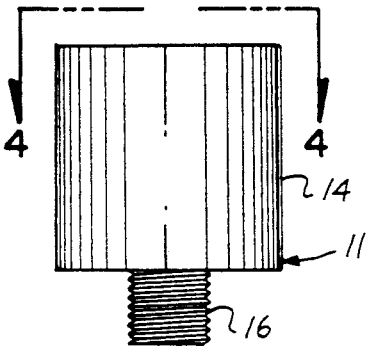
FIG. 3 is an enlarged orthographic view of the socket structure.
Figure 4:
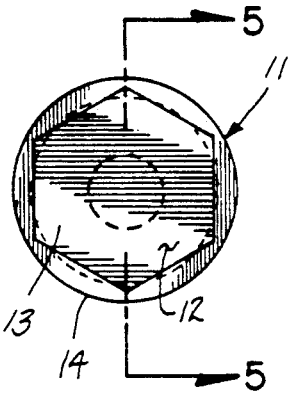
FIG. 4 is an orthographic view, taken along the lines 4—4 of FIG. 3 in the direction indicated by the arrows.
Figure 5:
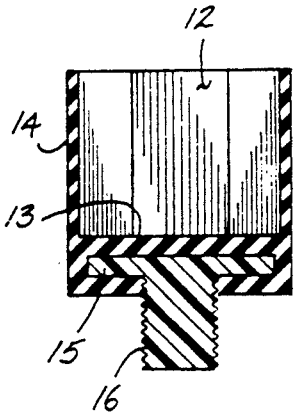
FIG. 5 is an orthographic view, taken along the lines 5—5 of FIG. 4 in the direction indicated by the arrows.

With reference now to the drawings, and in particular to FIGS. 1 to 10 thereof, a new and improved fastener holding apparatus embodying the principles and concepts of the present invention and generally designated by the reference numeral 10 will be described.

Figure 7:
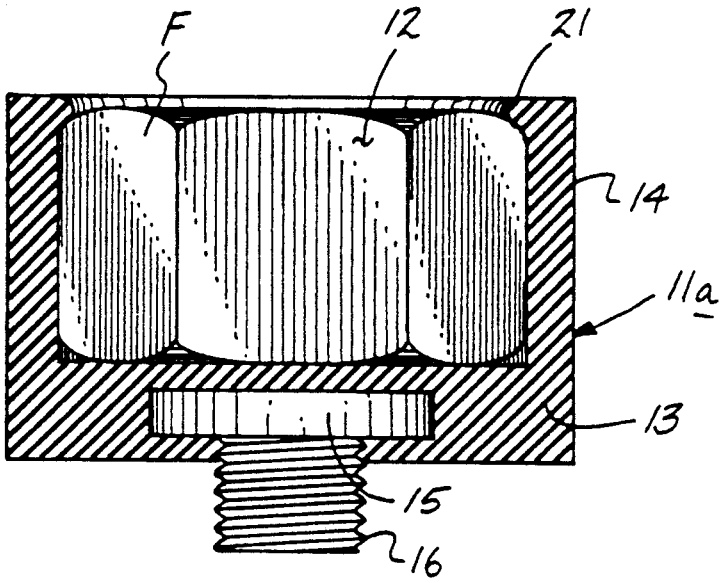
FIG. 7 is an orthographic side view of a modified socket structure.
Figure 8:
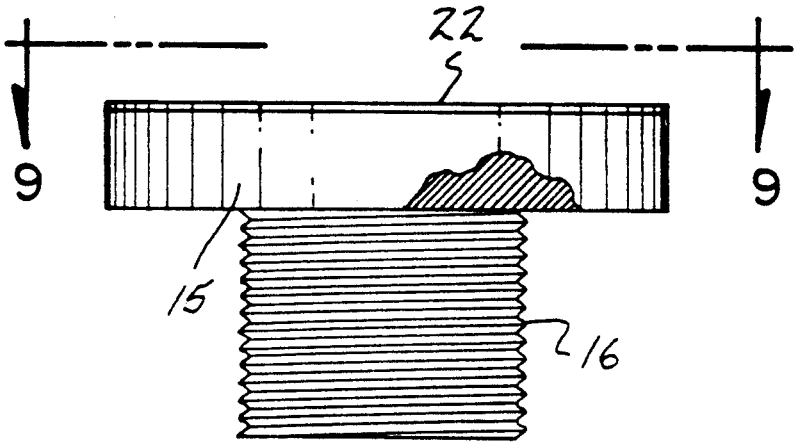
FIG. 8 is an enlarged orthographic view, partially in section, of the reinforcing plate structure mounted within the socket floor web.
Figure 9:
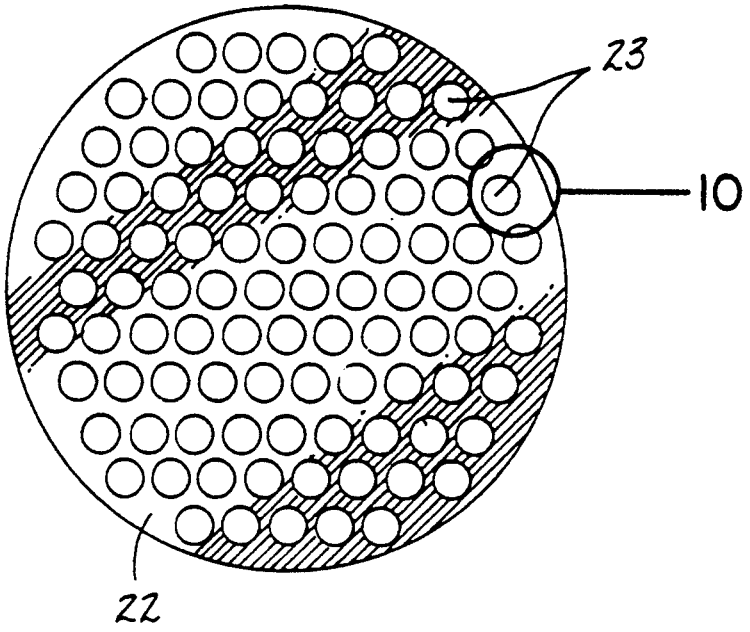
FIG. 9 is an orthographic view, taken along the lines 9—9 of FIG. 8 in the direction indicated by the arrows.
Figure 10:
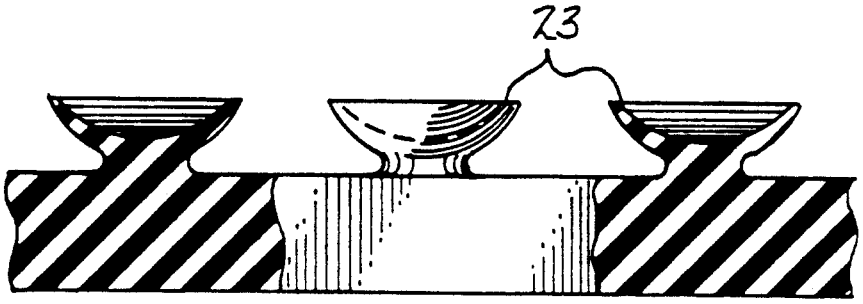
FIG. 10 is an enlarged orthographic view, partially in section, of section 10 as set forth in FIG. 9.

More specifically, the fastener holding apparatus 10 of the instant invention essentially comprises a socket member 11 defining a socket cavity 12 to receive a fastener such as a nut member, as indicated in the FIG. 7, or alternatively a stud that projects from the socket cavity 12. The socket member 11 includes a socket floor web 13 having a generally resilient fastener engaging side wall 14 of a cylindrical exterior surface and a polygonal cavity structure 12. A mounting hub 16 is integrally and orthogonally mounted to a rigid reinforcing plate 15 that is mounted within the floor web 13, such that the mounting hub 16 is coaxially aligned relative to the socket member cavity 12. A first shaft 17 having a forward end 17*a* is arranged to threadedly receive the mounting hub 16, with the first shaft 17, as indicated, to include a first shaft boss coaxially aligned with the first shaft projecting from the second end of the first shaft for reception within a second shaft 18, and more specifically within a second shaft forward end 18*a* to provide for extension of the socket member 11 as required. It should be understood that an additional first shaft member 17 may be provided to provide for extension of the organization as necessary.

As seen in FIG. 7, a modified socket member 11*a* is provided, wherein the reinforcing plate 15 is formed of a magnetic material for enhanced adherence to a fastener "F" directed into the cavity 12. Further, the reinforcing plate 15 is formed with a reinforcing plate resilient laminate covering 22 having a matrix of suction cup members 23 projecting into the cavity 12 through the floor web 13 for enhanced adherence to a fastener structure. Further, the resilient side wall 14 includes a side wall resilient annular rib 21 directed over the cavity 12 concentric relative to the socket member cavity 12 for enhanced engagement as the fastener is secured to a workpiece, the fastener "F" is then withdrawn from within the cavity 12 with the annular rib 21 being displaced upon removal of the fastener relative to the cavity.

Figure 6:
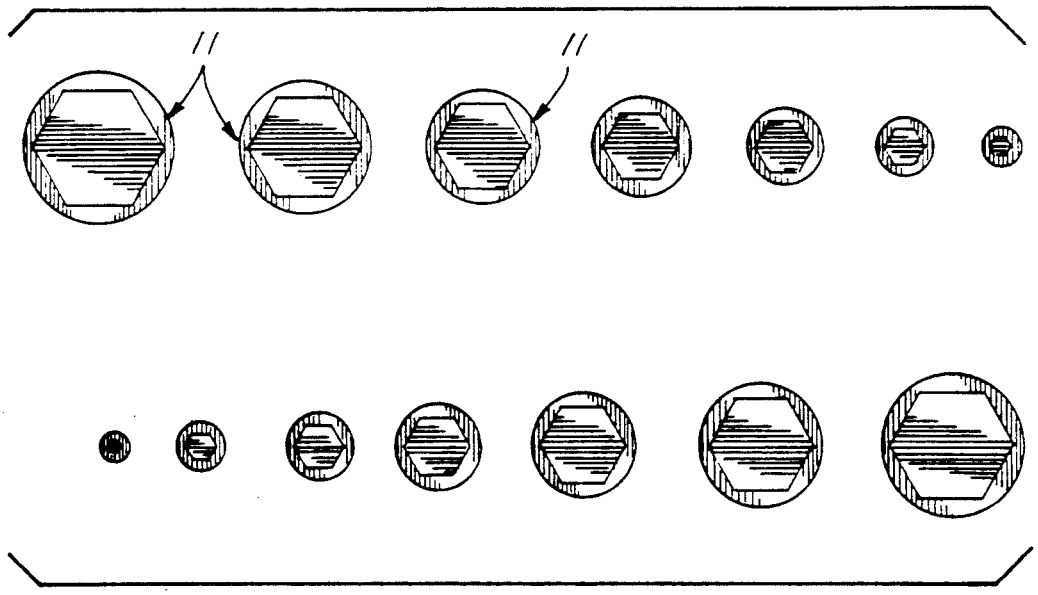
FIG. 6 is an orthographic top view of an array of the sockets of various sizes.

It should be noted that the FIG. 6 indicates that the socket members 11 may be formed of various sizes as required, as understood in the art of mounting fastener structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fastener holding apparatus, comprising, a socket member, the socket member having a socket member cavity of polygonal configuration, with the socket member including a resilient side wall, and a floor web orthogonally oriented relative to the side wall, the floor web including a reinforcing plate mounted within the floor web, with the reinforcing plate including a mounting hub coaxially aligned with the socket member projecting from the socket member, and a shaft, wherein the shaft includes a shaft forward end for securing the mounting hub therewithin.

2. An apparatus as set forth in claim 1 wherein the shaft includes a shaft rearward end, the shaft rearward end including a boss member, and a further shaft, wherein the further shaft is arranged for receiving the boss member, wherein the further shaft, the shaft and the socket member are coaxially aligned.

3. An apparatus as set forth in claim 2 wherein the reinforcing plate is orthogonally oriented relative to the side wall, and the reinforcing plate includes a resilient laminate covering, with the resilient laminate covering including a matrix of suction cup members projecting into the cavity from the floor web.

4. An apparatus as set forth in claim 3 wherein the resilient side wall includes a side wall resilient annular rib, wherein the annular rib is directed over the cavity and concentrically oriented relative to the socket member.

* * * * *